United States Patent [19]

Vives et al.

[11] Patent Number: 4,807,694

[45] Date of Patent: Feb. 28, 1989

[54] PROCESS FOR REGULATING THE LEVEL OF THE LINE OF CONTACT OF THE FREE SURFACE OF THE METAL WITH THE MOULD IN VERTICAL CASTING

[75] Inventors: Charles Vives, Chateaurenard; Bernard Forest, Saint Entienne; Jean-Pierre Riquet, Saint Etienne de St Geoirs, all of France

[73] Assignee: Cegedur Societe de Transformation de l'Aluminium Pechiney, Paris, France

[21] Appl. No.: 124,357

[22] Filed: Nov. 18, 1987

Related U.S. Application Data

[63] Continuation of Ser. No. 870,762, filed as PCT FR85/00252 on Sep. 18, 1985, published as WO86/01756 on Mar. 27, 1986, abandoned.

[30] Foreign Application Priority Data

Sep. 19, 1984 [FR] France ..... 84 14740

[51] Int. Cl.[4] ..... B22D 27/02

[52] U.S. Cl. ..... 164/466; 164/502

[58] Field of Search ..... 164/502, 503, 504, 466, 164/467, 468

[56] References Cited

U.S. PATENT DOCUMENTS 4,355,679 10/1982 Wilkins ..... 164/466

4,456,054 6/1984 Henders ..... 164/466 X

FOREIGN PATENT DOCUMENTS 5232824 3/1977 Japan .

*Primary Examiner*—Kuang Y. Lin

*Attorney, Agent, or Firm*—Oblon, Fisher, Spivak, McClelland & Maier

[57] ABSTRACT

In a continuous vertical casting operation carried out in a mould 3, a coil 7 applies a periodic magnetic field of variable strength whose direction is substantially parallel to the axis of the mould 3 to the liquid 5 as it solidifies, in order to regulate the level of the line of contact of the free surface of the metal 5 with the mould 3. The height of the contact of the metal with the mould can be reduced from $h_1$ to $h_2$ by applying the magnetic field, and the strength of the field is adjusted in dependence on the desired level. The procedure is used in casting semifinished metallurgical products, in particular in aluminium and its alloys, in which there is a wish to obtain a cortical region of zero thickness, a fine grain without the preliminary addition of refining agents, and an absence of pitting.

7 Claims, 1 Drawing Sheet

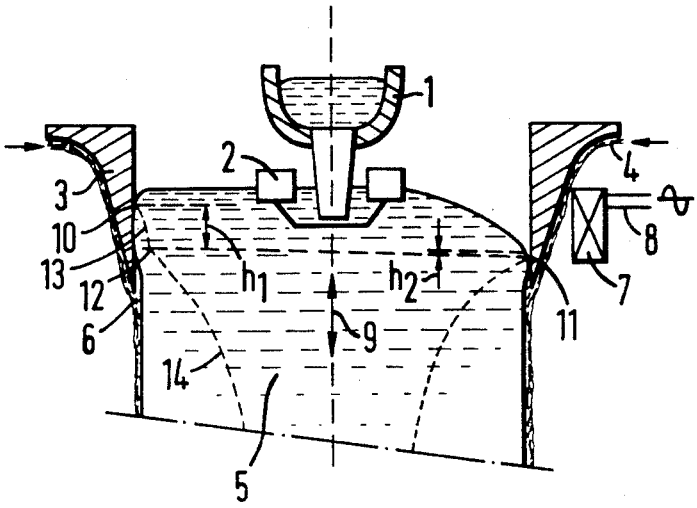
1
2
3
4
10
13
12
6
h1
h2
9
14
5
11
7
8

PROCESS FOR REGULATING THE LEVEL OF THE LINE OF CONTACT OF THE FREE SURFACE OF THE METAL WITH THE MOULD IN VERTICAL CASTING

This application is a continuation of application Ser. No. 870,762, filed as PCT FR85/00252 on Sept. 18, 1985, published as WO86/01756 on Mar. 27, 1986, now abandoned.

This invention relates to vertical casting. More particularly and indeed exclusively the invention concerns a process for regulating the level of the line of contact of the free surface of the metal with the mould in vertical casting.

When manufacturing semifinished metallurgical products by casting ferrous or light metals such as aluminium and its alloys, one seeks to produce cast products such as ingots, billets and plates that enjoy the best possible degree of physical and chemical homogeneity, in order to avoid the occurrence of certain defects in the subsequent operation of transforming such products into other shapes such as sheets and wires.

In most known and used industrial casting processes homogeneity defects of greater or lesser magnitude arise when the metal passes from the liquid to the solid state. This is due essentially to the conditions of cooling of the cast products being different from one point to another. Thus, when casting the metal in an ingot mould having a vertical passage in which the metal is successively cooled indirectly by way of the mould and then directly by a sheet of water, it is found that the semifinished products have an external so-called "primary cortical layer". That layer, whose structure and composition differ from those of the internal part of the semifinished products, results from the indirect cooling of the metal in contact with the mould. In addition, other forms of heterogeneity, which are much less pronounced but which are just as troublesome, may appear, such as the small holes or little pits that are due in particular to formation of a layer of oxide at the surface of the liquid metal when in contact with the atmosphere and its dispersion in the metal mass.

Many attempts to solve those problems have been made. Existing solutions are satisfactory to a greater or lesser degree in eliminating or at least reducing the seriousness of such heterogenity phenomena.

Thus, in French Patent Specification No. 1 509 962, electromagnetic casting is recommended. In this process, the fact that the metal is confined by means of forces of electromagnetic origin means that it is possible to eliminate the mould and thus avoid the appearance of the cortical layer, as there is no longer any indirect cooling. This improves the level of homogeneity of the semifinished products. However, the process suffers from a number of disadvantages.

Thus, the casting works must be provided with an electrical installation that is relatively complicated and expensive by virtue of the need to provide currents at a non-industrial frequency (500 to 4000 Hz) in order to generate a suitable confinement field; the danger of heterogeneity by virtue of small holes or pits is increased by virtue of the absence of any mould and therefore an increase in the area of liquid metal that may be oxidized, and by the phenomenon of stirring of the liquid mass caused by the confinement field, which contributes greatly to dislocation of the film of oxide and its dispersion in the metal. Moreover, it is often difficult to create a suitable confinement effect when staring up the electromagnetic casting process, and safety of the operating personnel may be put in question when casting aluminum and its alloys because, if there is an electrical failure, liquid metal, being no longer confined, will spread out outside the mould and can come into contact with the direct cooling fluid, thus causing an explosion.

Other simpler solutions have also been proposed in order to reduce the thickness of the cortical layer. For example, French Patent Specification No. 1 398 526 teaches the use of a strip of fiberfrax which is stuck to the mould so as to reduce the height of the metal in contact with the mould to reduce the effects due to indirect cooling. However, that reduction in height cannot be fixed once and for all as it depends in particular on the casting speed. Thus, when that parameter varies, it is necessary either to change the mould or at least to modify the height of the strip. That means that there is a lack of flexibility in a solution which in the ultimate analysis only provides for partial suppression of the heterogeneity phenomena.

In French Patent Specification No. 1 496 241, the disadvantages of indirect cooling are eliminated by using a mould of graphite, which is not cooled, but that process then encounters difficulties in regard to maintenance and frequent changing of the mould, due to the fragility of that material.

Another solution is to use moulds with a striated or ribbed internal surface, by means of which the thickness of the cortical layer is reduced by more than 30% when casting for example aluminium 1050. However, besides the machining of such moulds, which considerably increases their cost, that process again suffers from the disadvantages that arise out of adapting the mould and, in this case, the ribs to each casting speed.

Also known is casting with a feeder head, referred to as the hot top process, but that also suffers from the disadvantage of giving rise to periodic solidification of the meniscus, which is the cause of small folds at the surface of the semifinished products, as well as involving difficulties when starting up the operation.

Finally and more recently, French Patent Specification No. 2 417 357 describes a process in which the axial length of the part of the mould in contact with the liquid metal is varied by using a sleeve that slides on the inside wall surface of the mould. Such a system suffers from the disadvantage, upon untimely solidification of the metal, that it causes the mould and the sleeve to stick together, thus causing the components to tear when the sliding movement is started up.

The present invention results from efforts to produce homogenous semifinished products in which the thickness of the cortical layer is virtually zero, the product is of a refined grain and the surface of the product is free of pitting.

It was observed that starting up casting is easier in direct proportion to a rise in the level of metal in the mould. In fact, with a low level, the float that regulates the level and the feed of metal to the mould approaches the solidification front and, for semifinished products of small dimensions, runs the risk of being blocked by untimely solidification of the metal so that it can no longer perform its function. Likewide, the camber phenomenon, which occurs with semifinished products of substantial width, also prevents the casting operation from being started up with the metal at a low level. On the other hand, in the steady state, it is preferable to cast with the height of metal in the mould as low as possible, thereby limiting the height of contact of the metal with the wall of the mould and thereby reducing the thickness of the cortical zone.

Therefore, taking as the starting point a conventional mould in which a constant height of metal is retained, that height being fixed by the position of the float but being sufficient not to interfere with proper operation of the float, it was necessary to limit to the maximum possible degree the height of contact of the metal with the surface of the mould. This amounted to finding a way of regulating the level of the line of contact of the free surface of the liquid metal with the wall of the mould.

In accordance with the invention, there is provided a continuous vertical casting operation in which the level of the line of contact of the free surface of the metal with the mould is regulated by applying to the liquid, during the course of its solidification, a periodic magnetic field of variable strength whose direction is substantially parallel to the axis of the mould and adjusting the strength of the field in dependence on the desired level.

By proceeding in accordance with the present invention, and in particular with the preferred embodiments described below, a number of advantages are obtainable. Thus, the electrical installations are less complicated than those that have to be used for the electromagnetic casting process and the transfer from the casting start-up phase to the steady-state operating phase is easy. It is also easy to adapt to variations in parameters such as the casting speed since the process does not require any modification in the equipment such as a change of mould, and possible to apply the invention to any type of conventional mould. No movement of components is involved, and the risk of an explosion due to liquid metal leakage is less than with the electromagnetic casting process.

In carrying out the present invention, surrounding the mould with a circular coil comprising an electrical circuit formed by one or more windings and feeding it with an alternating current at a sufficient industrial voltage made it possible to modify the profile of the meniscus of the metal and in particular to vary the level of the line of contact of the metal with the mould, more especially as the variations in the feed voltage and, in a correlated manner, the strength of the field generated increased.

Thus, by increasing the strength of the field, it was possible to lower the level and consequently to reduce the height of the region of contact between the metal and the mould. In contrast, by reducing the strength of the field, it was possible to raise the level and consequently to increase the height of the contact region.

The attraction of such a process is therefore that it makes it possible to reduce the height of the metal-mould contact and consequently the thickness of the cortical layer in a simple fashion with a coil supplied with a current at an industrial frequency of 50 or 60 Hz, the only repercussion of any electrical failure being to vary the height of metal in the mould, that is to say, any danger of liquid metal leakage is eliminated, which is not the case when using the electromagnetic casting process.

Moreover, the presence of a mould, while limiting the possibility of oxidation of the liquid metal at the level of the meniscus by virtue of the contact of the mould with the metal, prevents any displacement of the film of oxide towards the side wall and therefore any danger of pitting at the surface of the semifinished product. Moreover, the field applied to the metal also has the effect of generating forces within the liquid that homogenise the cooling action and that tend to cause the cast grain to be refined.

The shape of the coil that generates the magnetic field preferably conforms to that of the mould so that it generates a field in a direction which is substantially parallel to the axis of the mould. It is disposed along that axis in such a way that the region in which the field exerts its maximum action is at a level between half and a third of the height of the mould as measured from its base.

When carrying out a casting operation, such a process makes it possible to provide for normal start-up under the best possible conditions, that is to say, with a high level of metal in the mould. For that purpose, the strength of the field is reduced or possibly shut off altogether so as to eliminate any modification in the normal level of the metal. Subsequently, to go into the steady-state operating phase, the strength of the field is increased until a minimum height is achieved, resulting in a minimum thickness in the cortical layer. The maximum admissible field strength is easily detected by the occurrence of deformation of the surface of the cast product when that maximum is exceeded. It is therefore only necessary to determine that maximum in the course of starting up a test casting, and then use it for all the casting operations of the same type.

That maximum generally corresponds to the time at which the level reached by the line of contact corresponds to the level of the line of intersection between the solidification front due to indirect cooling and the solidification front due to direct cooling in a conventional casting operation. The contact height is then virtually reduced to a circular line and the cortical layer does not occur.

Depending on the type of alloy being cast, it is known that it will be necessary to carry out the casting operation at different speeds. The process according to the invention makes it possible to modify the strength of the field in order to adapt it to the variations in speed and to determine, as before, the maximum value of the admissible strength of the field for each of those casting speeds.

The invention will be better appreciated by reference to the single FIGURE of the accompanying drawing, which is a view in vertical section of two half moulds, that on the left being used in accordance with the prior art while that on the right is used in accordance with the process of the invention.

BRIEF DESCRIPTION OF THE DRAWING

In the drawing, metal 5 is supplied to an ingot mould 3 by a liquid metal feed nozzle 1. The mould 3 has a level regulating float 2 and is cooled directly by fluid 4 which then cools the metal 5 directly at point 6. The right-hand half mould is equipped with a coil 7 which is fed with a.c. 8 in order to generate the magnetic field whose direction is indicated at 9 and to cause a drop in the level of the line of contact of the surface of the metal with the mould from a point 10 in the prior casting operation to a point 11 in accordance with the invention, which point is disposed at the level of intersection 12 of solidification front 13, which results from indirect cooling, and solidification front 14, which results from direct cooling. It will be seen therefore that the height of contact of the metal with the mould has been reduced from a value $h_1$ to a value $h_2$ which is extremely small and which can be assimilated to the point 11.

The invention may be illustrated by reference to the following examples of use thereof:

Taking an aluminium mould with a diameter of 320 mm and a height of 100 mm, an aluminium alloy of type 2214, in accordance with the Aluminium Association standards, was cast at a speed of 60 mm/min. The float regulated the level of metal at a position halfway up the mould and the cooling fluid came into contact with the skin of the cast billet at approximately 10 mm below the base of the mould.

In a first test, the casting operation was carried out under the conditions of the prior art and micrographic examination of different sections of the billet revealed that the average thickness of the cortical layer was 18 mm.

A series of tests was then carried out, in the course of which the mould was surrounded by an annular coil that was 372 mm in inside diameter, 465 mm in outside diameter and 48 mm in height and was formed by 120 turns of enamelled copper wire of a diameter of 3.35 mm and operated with an alternating current at 50 Hz.

Each of the tests was carried out with a different electrical voltage and the corresponding mean cortical thicknesses were measured, as well as the size of the grains, using the inter-section methods.

The results are set out in the following Table:

| | | | | | |
|---|---|---|---|---|---|
| Voltage in volts | 0 | 50 | 100 | 150 | 180 |
| Cortical thickness in mm | 18 | 16 | 13 | 9 | 0 |
| Grain size in μm | 500 | | | 300 | 180 |

It will thus be seen that the application of the process according to the invention provides a progressive reduction in the thickness of the cortical layer in proportion to an increase in the electrical voltage at the terminals of the coil in proportions such that the thickness of the cortical layer falls to zero at a voltage of 180 volts.

At the same time, the grain size decreases so that, starting from a metal having grains measuring 500 μm, in conventional casting, the procedure according to the invention gives grains that measure 180 μm on average.

Moreover, no pitting is found.

The present invention can be used in casting semifinished metallurgical products, in particular in aluminum and its alloys, for example lithium-aluminium alloys, in which there is a wish to produce materials having a cortical region of virtually zero thickness, a fine grain without the preliminary addition of refining agents such as AT5B, and no pitting.

We claim:

1. A process for regulating a level of a line of contact of a free surface of a liquid metal with a mold during a continuous vertical casting operation, said process comprising the steps of:

supplying said liquid metal to the inside of said mold;

permitting said liquid metal to solidify;

applying an alternating magentic field to said liquid metal in the course of the solidification thereof, said magnetic field in said liquid metal adjacent the level of the line of contact of the free surface of said liquid metal having a vertical direction substantially parallel with the axis of said mold, whereby substantially horizontal electromagnetic forces form a bulge in the free surface of the liquid metal; and adjusting the strength of said magnetic field to produce a desired value of the vertical level of the line of contact of the free surface of said liquid metal with said mold wherein the process further comprises the step of applying a magnetic field strength in a steady state casting condition which causes a level of said line of contact to reach a line of intersection between a solidification front of said liquid metal due to indirect cooling and a solidification front of said liquid metal due to direct cooling in a process wherein the magnetic field is not applied.

2. The process according to claim 1 wherein a frequency of said alternating current is an industrial standard frequency.

3. The process according to claim 1 wherein said field is positioned so as to have a maximum strength within a region of said mold between a half and a third of the height of said mold as measured from a base thereof.

4. The process according to claim 1 wherein said field is oriented such that an increase in the strength thereof lowers said level.

5. The process according to claim 1 wherein said field is oriented such that a decrease in the strength thereof raises said level.

6. The process according to claim 1 including the steps of:

establishing said strength of said field at a low level at a start up of the casting operation; and progressively increasing said field strength up to a level at which a surface of a product being cast begins to suffer deformation.

7. The process according to claim 1 wherein said field strength is modified when a casting speed varies.

* * * * *